United States Patent [19]

Le Coent et al.

[11] Patent Number: 4,464,289

[45] Date of Patent: Aug. 7, 1984

[54] SUPER-ALKALINIZED DETERGENT-DISPERSANT ADDITIVES FOR LUBRICATING OILS AND METHOD OF MAKING SAME

[75] Inventors: Jean-Louis Le Coent, Le Havre; Bernard Demourés, Puteaux, both of France

[73] Assignee: Orogil, Courbevoie, France

[21] Appl. No.: 506,775

[22] Filed: Jun. 22, 1983

[30] Foreign Application Priority Data

Jun. 24, 1982 [FR] France ..... 82 11058

[51] Int. Cl.[3] ..... C10M 1/40

[52] U.S. Cl. ..... 252/33.4; 252/18; 252/40.7; 252/42.7

[58] Field of Search ..... 252/18, 33.4, 39, 40.7, 252/42.7

[56] References Cited

U.S. PATENT DOCUMENTS

| | | | |
|---|---|---|---|
| 3,256,186 | 6/1966 | Greenwald | 252/33 |
| 3,282,835 | 11/1966 | Asseff | 252/33.2 |
| 3,464,970 | 9/1969 | Sakai et al. | 260/137 |
| 3,509,053 | 4/1970 | Branch | 252/18 |
| 3,862,981 | 1/1975 | Demoures et al. | 260/479 S |
| 3,928,216 | 12/1975 | Saunders et al. | 252/18 |
| 3,936,480 | 2/1976 | Demoures et al. | 260/404.5 |
| 3,966,621 | 6/1976 | Watkins et al. | 252/42.7 |
| 4,016,093 | 4/1977 | Koft, Jr. | 254/42.7 |
| 4,042,514 | 8/1977 | Giolito et al. | 252/48.6 |
| 4,049,560 | 9/1977 | Dominey | 252/18 |
| 4,222,882 | 9/1980 | Brulet et al. | 252/51.5 |
| 4,229,308 | 10/1980 | Brulet et al. | 252/47 |
| 4,251,379 | 2/1981 | Le Coent et al. | 252/33 |
| 4,293,431 | 8/1981 | Demoures et al. | 252/18 |
| 4,302,342 | 11/1981 | Demoures et al. | 252/18 |
| 4,382,004 | 5/1983 | Tassara | 252/25 |

FOREIGN PATENT DOCUMENTS

| | | |
|---|---|---|
| 1144084 | 3/1969 | United Kingdom . |
| 1280749 | 7/1972 | United Kingdom . |

*Primary Examiner*—Jacqueline V. Howard

[57] ABSTRACT

Super-alkalinized lubricating oil additives and a method of making them are disclosed. A magnesium alkylbenzenesulfonate and a sulfurized alkylphenol are carbonated in the presence of an oil, magnesium oxide, a glycol, and an amine. The resulting medium is neutralized and super-alkalinized with lime, and the glycol and sediment are removed.

20 Claims, No Drawings

SUPER-ALKALINIZED DETERGENT-DISPERSANT ADDITIVES FOR LUBRICATING OILS AND METHOD OF MAKING SAME

BACKGROUND OF THE INVENTION

The present invention relates to calcium and magnesium additives useful in improving the detergent, dispersant, and anti-wear properties of lubricating oils, and a method of preparing such additives.

It is known to add various compounds to lubricating oils to improve the properties of such oils. U.S. Pat. No. 4,251,379 discloses a high alkalinity additive for lubricating oils prepared by sulfurizing an alkylphenol in the presence of an alkylbenzene sulfonate of low or zero Total Basic Number (T.B.N.), an alkaline earth base, and an alkylene glycol, pre-carbonating the mixture thus obtained, super-alkalinizing and carbonating the resultant pre-carbonated mixture by means of an alkaline earth base, $CO_2$, and an alkylene glycol, and eliminating the excess alkylene glycol.

U.S. Pat. No. 4,382,004 discloses magnesium alkylphenates useful as additives for lubricating oils obtained by preparing a suspension of active magnesium oxide in methanol, contacting the suspension with a mixture containing an alkylphenol bearing one or more $C_6$–$C_{60}$ alkyl substituents, a dilution oil, and optionally, a heavy alcohol having a boiling point between 100° and 200° C., the ratio or number of moles of active magnesium oxide to number of recurrent phenolic OH units being between about 0.25 and 2, and carbonating the resultant medium under pressure with carbon dioxide.

SUMMARY OF THE INVENTION

The present invention relates to a method of making super-alkalinized lubricating oil additives, according to which a magnesium alkylbenzenesulfonate and a sulfurized alkylphenol are carbonated in the presence of an oil, magnesium oxide, a glycol, and an amine, the resulting medium is neutralized and superalkalinized with lime, and the glycol and sediment are removed.

The additives prepared according to this method are further characterized by a T.B.N. of at least 225, contain more than about 3.8% by weight of magnesium, and contain from about 2% to about 3% by weight of calcium.

The additives of the present invention have the advantages of being compatible with viscous oils, of containing only a small proportion of sediment, and of having a low viscosity. These additives have been found capable of improving not only the detergent qualities, but also the dispersant and anti-wear qualities of lubricating oils.

DETAILED DESCRIPTION OF THE INVENTION

The additives of the invention are obtained by a process comprising:

(a) carbonating (first carbonation) a reaction medium until a sediment weight of less than about 1.5% by weight (referred to the reaction medium) is obtained, the medium comprising a magnesium alkylbenzenesulfonate having a T.B.N. up to about 20, a sulfurized alkylphenol, a dilution oil, and a milk of magnesia mixture comprising active magnesium oxide, a glycol, and an amine;

(b) adding lime to the carbonated medium to neutralize and super-alkalinize the sulfurized alkylphenol present in the medium;

(c) removing water and optionally carbonating (second carbonation) the resulting mixture;

(d) removing glycol from the medium, preferably by distillation; and (e) removing sediment from the medium, preferably by filtration.

As used herein, the term "magnesium alkylbenzenesulfonate" refers to any solution containing from about 25% to about 80% by weight, preferably from about 30% to about 70% by weight, of a magnesium alkylbenzenesulfonate in an oil which may or may not be the same as the dilution oil.

The magnesium alkylbenzenesulfonates useful in the present invention include the magnesium salts of sulfonic acids obtained by sulfonation of alkylbenzenes derived from $C_{15}$–$C_{30}$ olefins or olefin polymers.

As used herein, the term "sulfurized alkylphenol" refers to a mixture obtained by sulfurizing an alkylphenol with sulfur or sulfur chloride. The sulfurizing process is within the skill of the art. The mixture consists mainly of nonsulfurized alkylphenol and sulfurized alkylphenol. The sulfurized alkylphenol is represented by the following general formula:

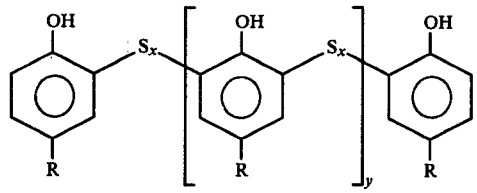

wherein R is a mono-valent alkyl radical of $C_9$–$C_{30}$, preferably $C_9$–$C_{22}$; x is from 1 to 3; and y is from 0 to 6.

The mixture constituting the "sulfurized alkylphenol" may be represented by the following average formula:

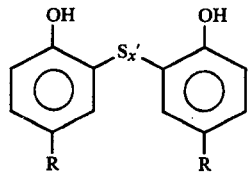

where x' is from 1 to 3, and generally averages from 1.4 to 2.5.

As used herein, the term "active" magnesium oxide refers to magnesium oxide (MgO) with a specific surface greater than or equal to 80 $m^2/g$, preferably from about 100 to about 170 $m^2/g$. Active magnesium oxides useful in the invention include "Maglite DE," which has a specific surface close to 140 $m^2/g$ (marketed by Merck & Co.), and "Ferumag," which has a specific surface close to 160 $m^2/g$ (marketed by Rhone-Poulenc).

The amines useful in the present invention include polyaminoalkanes, preferably polyaminoethanes, particularly ethylenediamine, and aminoethers, particularly tris(3-oxa-6-aminohexyl)amine. The amine may be added prior to or during the carbonation.

The dilution oils useful in the present invention include naphthenic oils and mixed oils, and preferably paraffinic oils such as neutral 100 oil. The quantity of dilution oil used is such that the amount of oil in the final product (including that originating from the initial magnesium alkylbenzenesulfonate solution) constitutes from about 20% to about 60% by weight of the final product, preferably from about 25% to about 55%, and more preferably from about 30% to about 45%.

A preferred method of making the additives of the present invention is to use reagents in quantities such that:

the ratio of the quantity of magnesium alkylbenzenesulfonate, expressed in moles of alkylbenzenesulfonic acid, to the quantity of sulfurized alkylphenol, expressed in moles of alkylphenol, is from about 0.15 to about 5.5, preferably between 0.25 and 2;

the quantity of active MgO corresponds to a "base ratio" (that is, the ratio of the number of moles of basic magnesium, i.e., not fixed to the alkylbenzenesulfonic acid to the number of moles of nonbasic magnesium, i.e., fixed to the alkylbenzenesulfonic acid) of from about 5 to about 14, and preferably from about 7 to about 11;

the quantity of glycol corresponds to a MgO/glycol molar ratio of from about 0.1 to about 0.7, preferably from about 0.3 to about 0.65;

the amount of amine is such that the ratio of moles of amine to moles of basic magnesium is from about 0.01 to about 0.4, preferably from about 0.04 to about 0.25; and the ratio of the quantity of lime, expressed in moles of lime, to the quantity of sulfurized alkylphenol, expressed in moles of alkylphenol, is from about 0.2 to about 2.5, preferably from about 0.4 to about 2.

When more than one carbonation step is used, the first carbonation is advantageously carried out in one or more stages at a temperature of from about 90° to about 140° C., preferably from about 110° to about 140° C. The milk of magnesia mixture is added to the medium containing the magnesium alkylbenzenesulfonate, sulfurized alkylphenol, and dilution oil, in one or more stages, each stage of addition of milk of magnesia mixture being followed by a carbonation stage. It is advantageous to carry out the first carbonation in two stages, the first stage in the presence of about two-thirds of the total quantity of milk of magnesia mixture followed by a second stage in which the remaining quantity of milk of magnesia mixture is added. Toward the end of the carbonation step, it is also advantageous to add a quantity of water corresponding to an $H_2O/MgO$ weight ratio of from about 0.1 to about 0.9.

The step of neutralizing and super-alkalinizing the sulfurized alkylphenol with lime is advantageously carried out at a temperature of from about 110° to about 145° C., preferably from about 120 to about 140° C.

The optional second carbonation step is advantageously carried out using a slight excess of $CO_2$ and at a temperature of from about 120° to about 170° C., preferably from about 130° to about 150° C.

The quantity of additive to be used with a particular lubricating oil depends on the intended use of the oil. Thus, for an oil for a gasoline engine, the quantity of additive employed is generally from about 1% to about 3.5% by weight; for an oil for a diesel engine the quantity of additive employed is from about 1.8% to about 5% by weight; and for an oil for a marine engine the quantity of additive may range up to about 25% by weight.

A great variety of lubricating oils can be improved with the additives of the present invention. These oils include naphtha-based, paraffin-based, and mixed-based lubricating oils and other hydrocarbon-based lubricants, for example, lubricating oils derived from coal products and synthetic oils such as alkylene polymers, alkyleneoxide-type polymers, and their derivatives, including the alkyleneoxide polymers prepared by polymerizing an alkyleneoxide in the presence of water or alcohols, for example, ethyl alcohol, the esters of dicarboxylic acids, liquid esters of phosphorus acids, alkylbenzenes and dialkylbenzenes, polyphenyls, alkylbiphenylethers, and silicon polymers.

Other additives may also be added to the lubricating oils, for example, anti-oxidant additives, anti-corrosion additives, and ashless dispersant additives.

The following examples present illustrative but non-limiting embodiments of this invention. Comparative data are also presented.

EXAMPLES

Characteristics Of The Product

In the following examples, product characteristics were measured according to the following procedures.

1. Measurement of the amount of sediment

The amount of sediment was determined according to ASTM Standard D 2273-67, with the following modifications:

a. Rotational speed of the centrifuge: 6,000 rpm;

b. Relative centrifugal force: 10,000;

c. The product to be analyzed was diluted to a ratio of 1:4 with gasoline E (25 $cm^3$ of product to be analyzed to 75 $cm^3$ of gasoline E); and d. Duration of centrifuging: 10 minutes.

2. Compatibility tests a. No. 1

This test was carried out by adding 10% by weight of the product to be tested to an SAE (Society of Automotive Engineers) 30 mineral oil, storing the resulting solution for one month at 20° C., and examining the appearance of the solution as a function of time.

Scoring:

1 for a clear and brilliant product, 2 for a very slightly turbid product, 3 for a turbid product.

b. No. 2

The finished product was added to an SAE 50 oil of paraffinic tendency to obtain a solution containing 125 millimoles of calcium plus magnesium.

The solution was stored for 24 hours, then centrifuged under the following conditions:

(1) Rotational speed: 6,000 rpm;

(2) Relative centrifugal force: 10,000; and (3) Duration of centrifuging: 1 hour.

The amount of sediment was then measured.

General Description Of Additive Preparation

(A) Preparation of a magnesium alkylbenzenesulfonate

A 3-liter flask is charged with:

1. an about 70% solution of sulfonic acid in neutral 100 dilution oil, said sulfonic acid having a molecular weight of approximately 470 (sodium salt mass);

2. neutral 100 dilution oil;

3. an about 50% aqueous calcium chloride solution;

4. Maglite DE so as to obtain a magnesium alkylbenzenesulfonate with a T.B.N. of approximately 3; and finally 5. a glycol (added over a 5 minute period).

The reaction medium is first heated for 30 minutes at 110° C. at atmospheric pressure and then for 30 minutes in a vacuum to distill off the water of reaction.

(B) Carbonation

The reaction flask from step A is charged with sulfurized dodecylphenol (DDP) containing about 11% by weight of sulfur.

Next, milk of magnesia mixture, prepared by mixing active magnesium oxide, a glycol, and a polyaminoalkane in a beaker with stirring, is added to the medium to be carbonated.

The carbonation is initially carried out for 3 hours at 135° C. with the introduction of $CO_2$ at a temperature of from about 110° to about 120° C. After three hours, water is preferably added and the carbonation continued for 1½ hours. The carbonated medium is then placed under a vacuum for 30 minutes.

(C) Stage of neutralizing and super-alkalinizing the sulfurized alkylphenol with lime The vacuum is broken and the sulfurized alkylphenol is neutralized and super-alkalinized by adding slaked lime at 120° C., progressively placing the medium under a vacuum ($120\times10^2$ Pa) and heating to 130° C. The vacuum is broken and the mixture is then heated to 145° C.

(D) Optional carbonation

The resulting mixture is then carbonated for 2 hours at 145° C.

(E) Removal of glycol

The glycol is then removed by distilling the mixture for 2 hours at 190° C. under a vacuum of $66.5\times10^2$ Pa.

(F) Filtration

The product medium is then filtered to remove sediment.

EXAMPLES 1 THROUGH 9

The reaction conditions for Examples 1 through 9 were as described above.

The quantities of reagents used in the different steps of Examples 1 through 9 are summarized in Tables I and II; the results obtained are summarized in Table II.

EXAMPLE 10

In Example 10, the different steps described in Example 3 were carried out by replacing the ethylenediamine with an equivalent amount of tris(3-oxa-6-aminohexyl-)amine (TOA). The quantities of reagents used in the different steps of Example 10 are also summarized in Tables I and II; the results obtained are summarized in Table II.

EXAMPLES 11 AND 12 (COMPARATIVE)

In Examples 11 and 12, the different operations were carried out in the absence of amine. The quantities of reagents used in the different steps of Examples 11 and 12 are also summarized in Tables I and II; the results obtained are summarized in Table II. Unlike the sediment percentages obtained according the process of the present invention, the amount of sediment obtained in Examples 11 and 12 before neutralization could not be reduced below 5% and 4%, respectively, even upon increasing the duration of carbonation.

TABLE I

| EXAMPLES | 1 | 2 | 3 | 4 | 5 | 6 | 7 | 8 | 9 | 10 | 11* | 12* |
|---|---|---|---|---|---|---|---|---|---|---|---|---|
| STAGE A | | | | | | | | | | | | |
| Sulfonic acid solution, g | 500 | 500 | 500 | 500 | 500 | 500 | 700 | 400 | 500 | 500 | 500 | 500 |
| Oil, g | 615 | 615 | 615 | 615 | 615 | 615 | 700 | 615 | 615 | 615 | 615 | 832 |
| MgO, g | 19 | 19 | 19 | 19 | 19 | 19 | 27 | 10 | 19 | 19 | 19 | 19 |
| $CaCl_2$ solution, g | 4 | 4 | 4 | 4 | 4 | 4 | 12 | 4 | 4 | 4 | 4 | 7.7 |
| Glycol, g | 38 | 38 | 38 | 38 | 38 | 38 | 81 | 20 | 38 | 38 | 38 | 38 |
| STAGE B | | | | | | | | | | | | |
| Sulfurized DDP, g | 419 | 419 | 419 | 419 | 419 | 419 | 138 | 550 | 419 | 419 | 419 | 730 |
| MgO, g | 129 | 129 | 129 | 129 | 129 | 129 | 200 | 129 | 160 | 129 | 129 | 180 |
| Glycol, g | 390 | 390 | 390 | 390 | 390 | 390 | 500 | 390 | 460 | 390 | 390 | 800 |
| Ethylene diamine, g | 16.5 | 16.5 | 16.5 | 16.5 | 33 | 8.5 | 26 | 16.5 | 19.5 | — | — | — |
| TOA, g | — | — | — | — | — | — | — | — | — | 16.5 | — | — |
| $Co_2$, g | 180 | 180 | 180 | 180 | 180 | 180 | 240 | 190 | 212 | 180 | 180 | 300 |
| $H_2O$, g | 24 | 100 | 85 | 85 | 85 | 85 | 112 | 85 | 100 | 24 | 85 | 110 |
| Sediment, % | 0.8 | 0.8 | 0.6 | 0.6 | 0.6 | 0.8 | 1.3 | 1 | 1 | 1.1 | 5 | 4 |

*Comparative.

TABLE II

| EXAMPLES | 1 | 2 | 3 | 4 | 5 | 6 | 7 | 8 | 9 | 10 | 11** | 12** |
|---|---|---|---|---|---|---|---|---|---|---|---|---|
| STAGE C | | | | | | | | | | | | |
| Lime, g | 100 | 100 | 100 | 100 | 100 | 100 | 70 | 100 | 100 | 100 | 100 | 165 |
| STAGE D | | | | | | | | | | | | |
| $CO_2$, g | 60 | 60 | 60 | — | 60 | 60 | 50 | 60 | 60 | 60 | 60 | 60 |
| Sediment, % | 1 | 0.8 | 0.8 | 1.5 | 0.6 | 1 | 1.5 | 1.3 | 1 | 1.4 | 6 | 5 |
| Analysis of finished product | | | | | | | | | | | | |
| Sediment, % | 0.07 | 0.04 | 0.04 | 0.1 | 0.04 | 0.04 | 0.04 | 0.12 | 0.08 | 0.04 | 0.2 | 0.15 |
| Mg, % | 4.5 | 4.5 | 4.5 | 4.4 | 4.55 | 4.4 | 5.3 | 4.4 | 5.2 | 4.35 | 3.6 | 3.8 |
| Ca, % | 3 | 3 | 3 | 2.95 | 3 | 3 | 2.4 | 3 | 2.9 | 2.9 | 2.8 | 2.8 |
| Viscosity at 100° C., cst | 420 | 350 | 350 | 550 | 370 | 360 | 430 | 381 | 390 | 334 | 460 | 550 |

TABLE II-continued

| EXAMPLES | 1 | 2 | 3 | 4 | 5 | 6 | 7 | 8 | 9 | 10 | 11** | 12** |
|---|---|---|---|---|---|---|---|---|---|---|---|---|
| T.B.N. | 270 | 270 | 270 | 264 | 271 | 268 | 272 | 268 | 283 | 262 | 220 | 228 |
| Compatibility tests | | | | | | | | | | | | |
| No. 1 | 1 | 1 | 1 | 1 | 1 | 1 | 1 | 1 | 1 | 1 | 2 | 1 |
| No. 2 | * | * | * | 0.1 | 0.01 | 0.01 | 0.1 | 0.003 | * | 0.1 | 2 | 0.1 |

*Trace amount.
**Comparative.

EXAMPLE 13

(A) Preparation of a magnesium alkylbenzenesulfonate with a T.B.N. close to 16

A 3-liter flask was charged with:

1. 500 g of an about 70% solution of sulfonic acid in neutral 100 oil, said sulfonic acid having a molecular weight of 470 (sodium salt mass);
2. 615 g of neutral 100 dilution oil; and
3. 4 g of an about 50% aqueous solution of calcium chloride.

151.5 g of Maglite DE and 432 g of glycol were mixed in a beaker and the flask was then charged with 87 g of this mixture and the resultant mixture was heated. When the temperature reached 110° C., a maximum vacuum was applied and the mixture was heated to 130° C.

The amount of sediment at this stage was about 0.3%.

(B) Carbonation

The vacuum was broken and the flask charged with 411 g of a sulfurized dodecylphenol containing about 11% sulfur followed by the remaining 496 g of the MgO and glycol mixture. $CO_2$ was then introduced. After 2 hours of carbonation at atmospheric pressure, the amount of sediment was about 4%. 19 g of ethylenediamine were then introduced and the carbonation continued.

At the end of the carbonation step (total time 5½ hours), the amount of sediment was about 1.2%. The carbonated medium was then placed under a vacuum.

(C) Neutralization, super-alkalinization, and purification

The vacuum was then broken and the flask charged with 100 g of slaked lime. The flask was raised to a temperature of 115° C. under a vacuum of $346\times10^2$ Pa and then heated for one hour at 140° C. under a vacuum of $346\times10^2$ Pa. The glycol was distilled off for two hours at 190° C. under a vacuum of $66.5\times10^2$ Pa.

The amount of crude sediment at the end of this stage was about 0.8%. The mixture was then filtered to remove sediment.

| Analysis of the finished product | | |
|---|---|---|
| Sediment | | 0.04% |
| Ca | | 3% |
| Mg | | 4.6% |
| T.B.N. | | 270 |
| Viscosity at 100° C. | | 500 cst |
| Compatibility Tests: | No. 1 | 1 |
| | No. 2 | 0.1% sediment after centrifuging. |

EXAMPLE 14

The same steps were carried out as described in Example 13 with the exception that the 19 g of ethylenediamine were combined with the 496 g of the MgO and glycol mixture.

The milk of magnesia mixture obtained in this manner was then added to the medium to be carbonated in three portions, each addition being followed by a carbonation step, the interval between each addition being about one hour.

| Analysis of the finished product | | |
|---|---|---|
| Sediment | | 0.04% |
| Ca | | 3% |
| Mg | | 4.6% |
| T.B.N. | | 270 |
| Viscosity at 100° C. | | 350 cst |
| Compatibility Tests: | No. 1 | 1 |
| | No. 2 | 0.1% sediment after centrifuging. |

We claim:

1. A lubricating oil additive prepared according to a method comprising the steps of:
   (a) carbonating a reaction medium until a sediment weight of less than about 1.5% by weight (referred to the weight of the reaction medium) is obtained, the medium comprising a magnesium alkylbenzenesulfonate having a T.B.N. up to about 20, a sulfurized alkylphenol, a dilution oil, and a milk of magnesia mixture comprising active magnesium oxide, a glycol, and an amine;
   (b) adding lime to the carbonated medium to neutralize and super-alkalinize the sulfurized alkylphenol present in the medium;
   (c) removing glycol from the medium; and
   (d) removing sediment from the medium; said additive having a T.B.N. of at least 225 and containing more than about 3.8% by weight of magnesium and from about 2% to about 3% by weight of calcium.
2. The additive of claim 1 wherein step (a) is carried out at a temperature of from about 90 to about 140° C.
3. The additive of claim 1 wherein the milk of magnesia mixture is added in separate portions to the mixture comprising the magnesium alkylbenzenesulfonate, sulfurized alkylphenol, and dilution oil, and wherein each addition of a portion of the milk of magnesia mixture is followed by a carbonation step.
4. The additive of claim 1 wherein in step (a) a quantity of water corresponding to a water/magnesium oxide weight ratio of from about 0.1 to about 0.9 is added toward the end of the carbonation.
5. The additive of claim 1 wherein neutralization and super-alkalinization with lime is carried out at a temperature of from about 110 to about 145° C.
6. The additive of claim 1 wherein the amine is a polyaminoethane.
7. The additive of claim 6 wherein the polyaminoethane is ethylenediamine.
8. The additive of claim 1 wherein the amine is an aminoether.

9. The additive of claim 8 wherein the aminoether is tris(3-oxa-6-aminohexyl)amine.

10. The additive of claim 1 further comprising, after step (b), removing water and then carbonating the resulting mixture.

11. The additive of claim 10 wherein said second carbonation step is performed at a temperature of from about 120 to about 170° C.

12. A lubricating oil additive prepared according to a method comprising the steps of:

(a) carbonating a reaction medium until a sediment weight of less than about 1.5% by weight (referred to the weight of the reaction medium) is obtained, the medium comprising a magnesium alkylbenzenesulfonate with a T.B.N. up to about 20, a quantity of sulfurized alkylphenol so that the ratio of the amount of magnesium alkylbenzenesulfonate, expressed in moles of sulfonic acid alkylbenzene, to the amount of sulfurized alkylphenol, expressed in moles of alkylphenol, is from about 0.15 to about 5.5, a dilution oil, and a milk of magnesia mixture comprising a quantity of active magnesium oxide corresponding to a base ratio of from about 5 to about 14, a quantity of a glycol corresponding to a magnesium oxide/glycol molar ratio of from about 0.1 to about 0.7, and a quantity of an amine corresponding to an amine/basic magnesium molar ratio of from about 0.01 to about 0.4;

(b) adding a quantity of lime to the carbonated medium so that the quantity of lime corresponds to a lime/sulfurized alkylphenol molar ratio of from about 0.2 to about 2.5;

(c) removing the glycol from the medium; and (d) removing sediment from the medium; said additive having a T.B.N. of at least 225 and containing more than about 3.8% by weight of magnesium and from about 2% to about 3% by weight of calcium.

13. The additive of claim 12 further comprising, after step (b), removing water and then carbonating the resulting mixture.

14. A lubricating oil additive prepared according to a method comprising the steps of:

(a) carbonating a reaction medium until a sediment weight less than about 1.5% by weight (referred to the weight of the reaction medium) is obtained, the medium comprising a magnesium alkylbenzenesulfonate with a T.B.N. up to about 20, a quantity of sulfurized alkylphenol so that the ratio of the amount of magnesium alkylbenzenesulfonate, expressed in moles of sulfonic acid alkylbenzene, to the amount of sulfurized alkylphenol, expressed in moles of alkylphenol, is from about 0.25 to about 2, a dilution oil, and a milk of magnesia mixture comprising a quantity of active magnesium oxide corresponding to a base ratio of from about 7 to about 11, a quantity of a glycol corresponding to a magnesium oxide/glycol molar ratio of from about 0.3 to about 0.65, and a quantity of an amine corresponding to an amine/basic magnesium molar ratio of from about 0.04 to about 0.25;

(b) adding a quantity of lime to the carbonated medium corresponding to a lime/sulfurized alkylphenol molar ratio of from about 0.4 to about 2;

(c) removing glycol from the medium; and (d) removing sediment from the medium; said additive having a T.B.N. of at least 225 and containing more than about 3.8% by weight of magnesium and from about 2% to about 3% by weight of calcium.

15. The additive of claim 14 further comprising, after step (b), removing water and then carbonating the resulting mixture.

16. A method of preparing a lubricating oil additive comprising the steps of:

(a) carbonating a reaction medium until a sediment weight of less than about 1.5% by weight (referred to the weight of the reaction medium) is obtained, the medium comprising a magnesium alkylbenzenesulfonate with a T.B.N. up to about 20, a sulfurized alkylphenol, a dilution oil, and a milk of magnesia mixture comprising active magnesium oxide, a glycol, and an amine;

(b) adding lime to the carbonated medium to neutralize and super-alkalinize the sulfurized alkylphenol present in the medium;

(c) removing glycol from the medium; and (d) removing sediment from the medium.

17. The method of claim 16 further comprising, after step (b), removing water and then carbonating the resulting mixture.

18. A method of improving the detergent, dispersant, and anti-wear properties of lubricating oils, comprising adding to said oils an effective amount of the additive of claim 1.

19. A method of improving the detergent, dispersant, and anti-wear properties of lubricating oils, comprising adding to said oils an effective amount of the additive of claim 12.

20. A method of improving the detergent, dispersant, and anti-wear properties of lubricating oils, comprising adding to said oils an effective amount of the additive of claim 14.

* * * * *